US007541983B2

(12) United States Patent
Wang

(10) Patent No.: US 7,541,983 B2
(45) Date of Patent: Jun. 2, 2009

(54) PLANER ANTENNA FOR RECEIVING DIGITAL TELEVISION PROGRAMS

(75) Inventor: Cheng-Si Wang, Chaunghua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 140 days.

(21) Appl. No.: 11/782,823

(22) Filed: Jul. 25, 2007

(65) Prior Publication Data

US 2009/0027274 A1 Jan. 29, 2009

(51) Int. Cl.
*H01Q 1/38* (2006.01)

(52) U.S. Cl. ..... 343/700 MS

(58) Field of Classification Search ..... 343/700 MS, 343/702

See application file for complete search history.

(56) References Cited

U.S. PATENT DOCUMENTS 6,670,922 B1 * 12/2003 Huang et al. ..... 343/700 MS
7,248,227 B2 * 7/2007 Chen ..... 343/795
7,391,384 B2 * 6/2008 Wong et al. ..... 343/795
7,486,237 B2 * 2/2009 Huang et al. ..... 343/700 MS

* cited by examiner

*Primary Examiner*—Hoang V Nguyen
(74) *Attorney, Agent, or Firm*—Rabin & Berdo, P.C.

(57) ABSTRACT

A planer antenna for receiving digital television programs is conductive and formed on a printed circuit board and has a body and an interface. The body is formed on the printed circuit board to receive an electromagnetic wave signal of television programs in a frequency range from around 470 MHz to around 860 MHz and has a longitudinal line of symmetry along which a series of shapes is formed starting with a trapezoid segment, then an hexagon segment and then a diamond segment and has a feeding port. The interface is rectangular, conductive and formed on the circuit board corresponding to the feeding port and connected electrically to the body at the feeding port. The interface has an output port formed on the interface for connecting to and transmitting signals to a television.

8 Claims, 6 Drawing Sheets

PLANER ANTENNA FOR RECEIVING DIGITAL TELEVISION PROGRAMS

BACKGROUND OF THE INVENTION

1. Field of Invention

The present invention relates to a planer antenna, and more particularly to a planer antenna for receiving digital television in a broad range of frequencies from around 470 MHz to around 860 MHz.

2. Description of the Related Art

Worldwide, analogue television signals are being phased out and replaced by digital television signals. However, different ranges of frequencies are used to transmit digital television signals in different countries. Therefore, antenna manufacture need to design or fine tune antenna for each country causing increases in cost and delays before designs are marketable in different countries.

Furthermore, conventional micro-strip antennas are planer to reduce their size, but the range of frequencies are normally very narrow.

The present invention provides a planer antenna for digital television programs to obviate or mitigate the shortcomings of the conventional micro-strip antenna.

SUMMARY OF THE INVENTION

The primary objective of the present invention is to provide a planer antenna for receiving digital television programs that has a wide receiving frequency range from around 470 to around 860 MHz.

The planer antenna for receiving digital television programs is conductive and formed on a printed circuit board and has a body and an interface. The body is formed on the printed circuit board to receive an electromagnetic wave signal of television programs in a frequency range from around 470 MHz to around 860 MHz and has a longitudinal line of symmetry along which a series of shapes is formed starting with a trapezoid segment, then an hexagon segment and then a diamond segment and has a feeding port. The interface is rectangular, conductive and formed on the circuit board corresponding to the feeding port and connected electrically to the body at the feeding port. The interface has an output port formed on the interface for connecting to and transmitting signals to a television.

Other objectives, advantages and novel features of the invention will become more apparent from the following detailed description when taken in conjunction with the accompanying drawings.

DETAILED DESCRIPTION OF THE INVENTION

Figure 1:
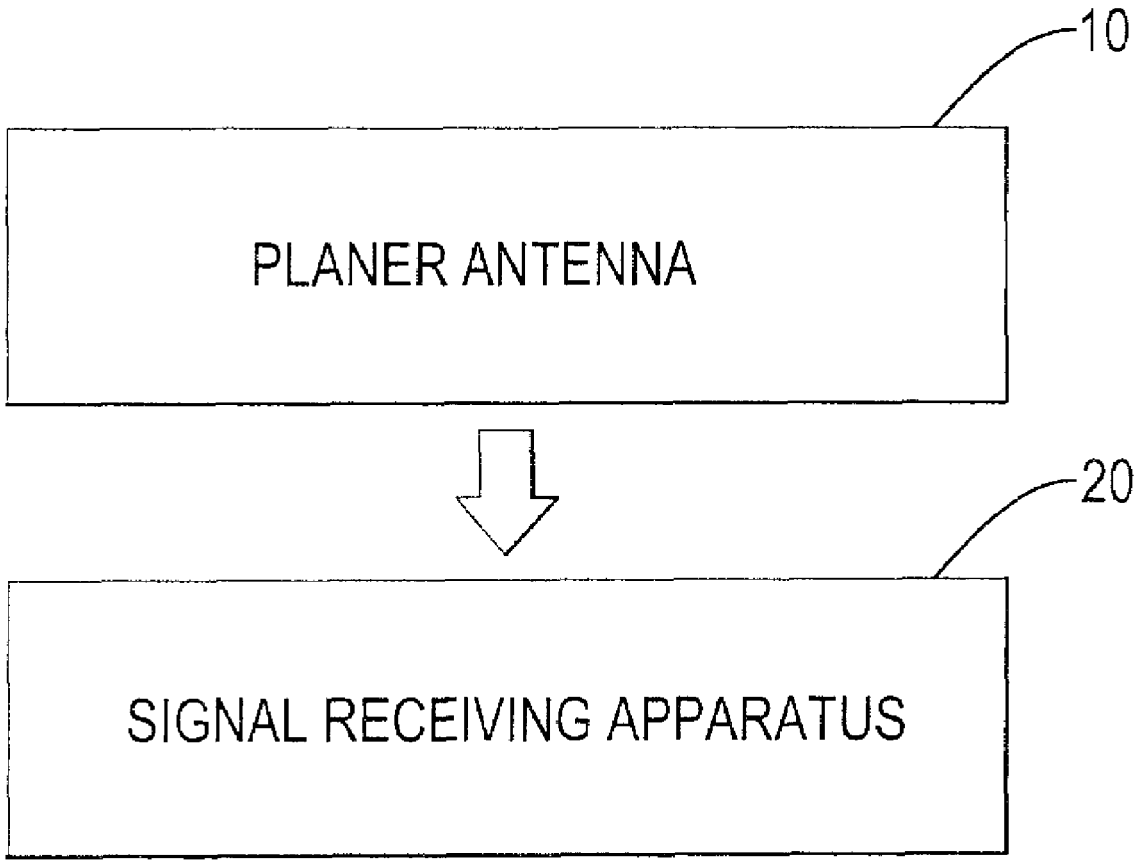
FIG. 1 is a block diagram of a planer antenna for receiving digital television programs in accordance of the present invention.
Figure 2:
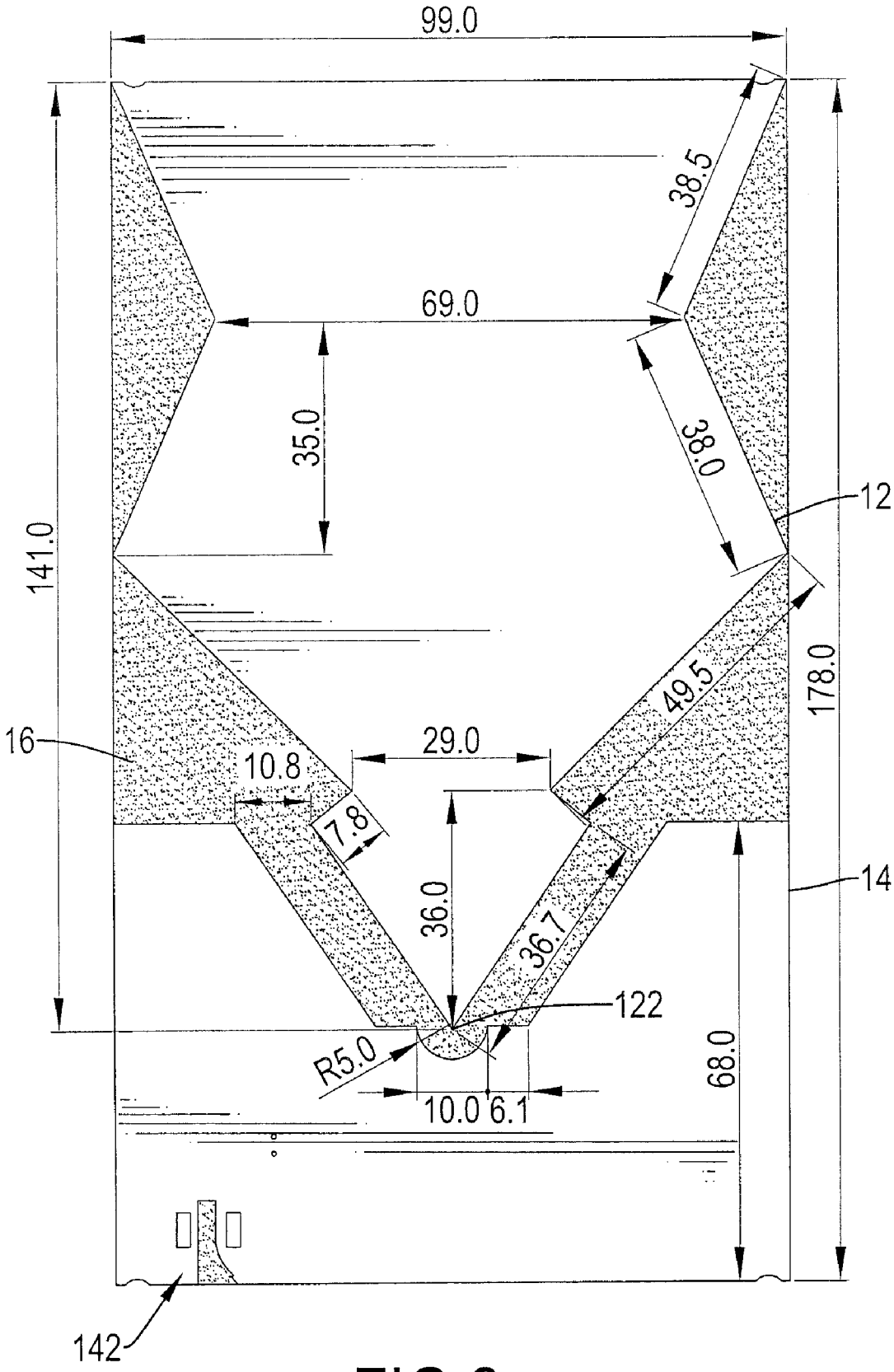
FIG. 2 is a top view of the planer antenna for receiving digital television programs in accordance of the present invention.

With reference to FIGS. 1 and 2, a planer antenna (10) for receiving digital television signal that is connected to a signal receiving apparatus (20) in accordance with the present invention comprises a printed circuit board, a body (12) and an interface (14).

The printed circuit board has at least one side and may have two sides being covered by a conductive film material such as copper film.

The body (12) is conductive pattern formed on the printed circuit board using co-planar designing techniques or micro-strip designing techniques. The body (12) can receive an electromagnetic wave signal for television programs in the range between around 470 MHz to around 860 MHz. A shape and dimension of the body (12) may be designed and simulated using antenna simulation software such as HFSS, Ansoft Analyzer, IE3D or the like.

The body (12) has a tip, a feeding port (122), and a line of longitudinal symmetry emanating from the tip, along which a sequence of shapes are formed towards the tip. The feeding port (122) is a signal output of the body (12) and is formed on the tip. The sequence of shapes comprises a trapezoid segment, a hexagon segment and a diamond segment.

The trapezoid segment has a base edge, two side edges and a parallel edge. The base edge is furthest from the tip. The base edge, each side edge and the parallel edge are 99.0 mm, 38.5 mm and 69.0 mm respectively.

The hexagon segment has a long transverse edge, a short transverse edge, two long side edges and two short side edges. The long transverse edge corresponds to and is formed adjacent to the parallel edge of the trapezoid. The short transverse edge is shorter than the long transverse edge. The long and short transverse edges are parallel and each has two ends. The short side edges of the hexagon are formed respectively adjacent to and correspond to the ends of the long transverse edge of the hexagon. The long side edges of the hexagon are longer than the short side edges, are formed respectively between the short edges of the hexagon and the ends of the short transverse edge of the hexagon. The long transverse edge, short transverse edge, short side edge and long side edge of the hexagon segment are 69.0 mm, 29.0 mm, 38.0 mm, and 49.5 mm respectively.

The diamond segment has a connecting edge, two short edges, two long edges and two apexes. The connecting edge of the diamond segment corresponds to and is adjacent to the short transverse edge of the hexagon segment. The short edges of the diamond segment are formed respectively adjacent to the connecting edge of the diamond segment. The long edges are formed respectively between the short edges of the diamond segment and the tip of the body (12). The apexes are defined respectively between the corresponding long and short edges of the diamond segment. The connecting edge, each short edge and each long edge of the diamond segment are 29.0 mm, 7.8 mm, and 36.7 mm respectively.

The interface (14) is rectangular, conductive and signal couples with the body (12) receives signals from the feeding port (122), is formed on the circuit board near the feeding port (122) and has two longitudinal edges, a broken transverse edge, a breach, a second transverse edge and an output port (142).

The broken transverse edge is formed aligned with the apexes of the diamond segment of the body (12).

The breach is non-conductive and is formed on the broken transverse edge of the interface (14), corresponds to and separates to the body (12) and the feeding port (122) from the interface (14). The second transverse edge is parallel to the base edge of the trapezoid segment.

The output port (142) is formed on the interface (14), may be on the longitudinal or second transverse edge of the interface (14) and electrically connects to and transmits signals to the signal receiving apparatus (20).

In a first embodiment of the present invention, the output port (142) is formed on the second transverse edge. Each transverse edge and longitudinal edge are 99.0 mm and 68.0 mm respectively.

Figure 3:
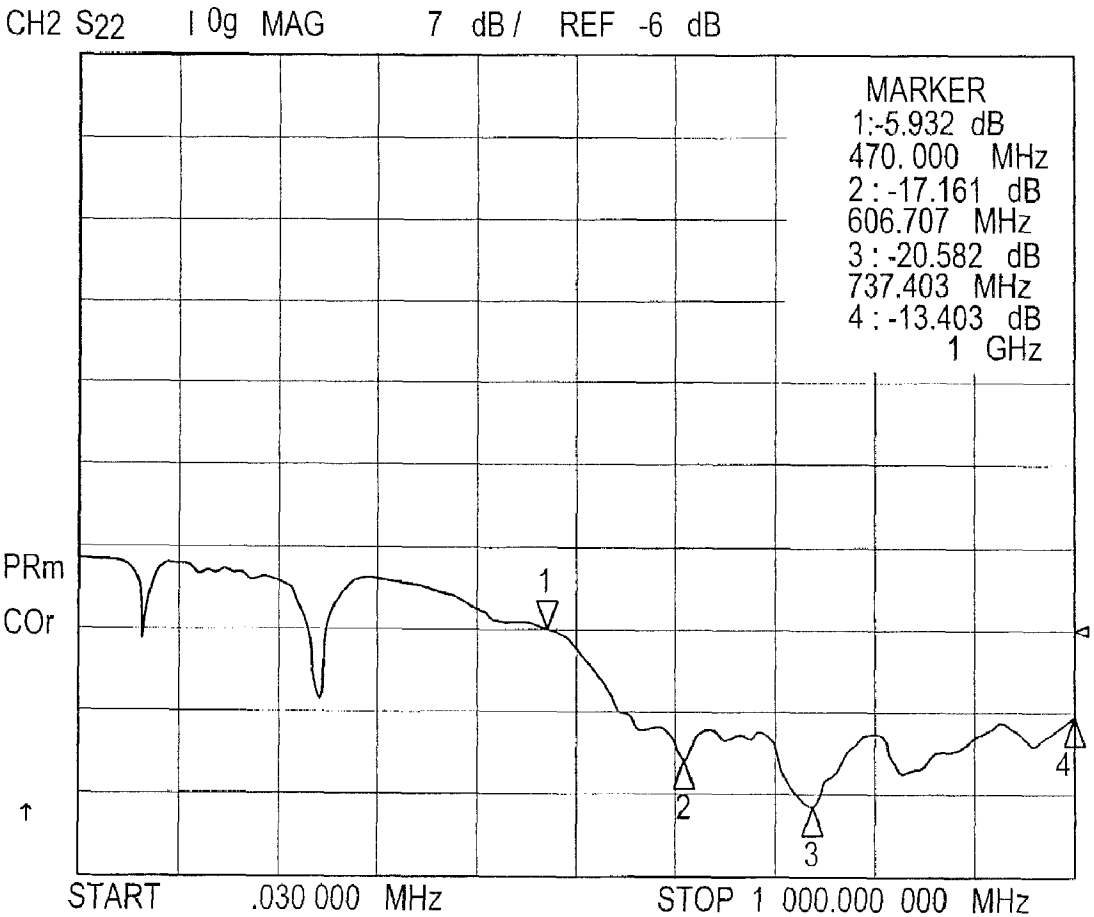
FIG. 3 is a plot of a return loss of the planer antenna for receiving digital television programs in FIG. 2.
Figure 4:
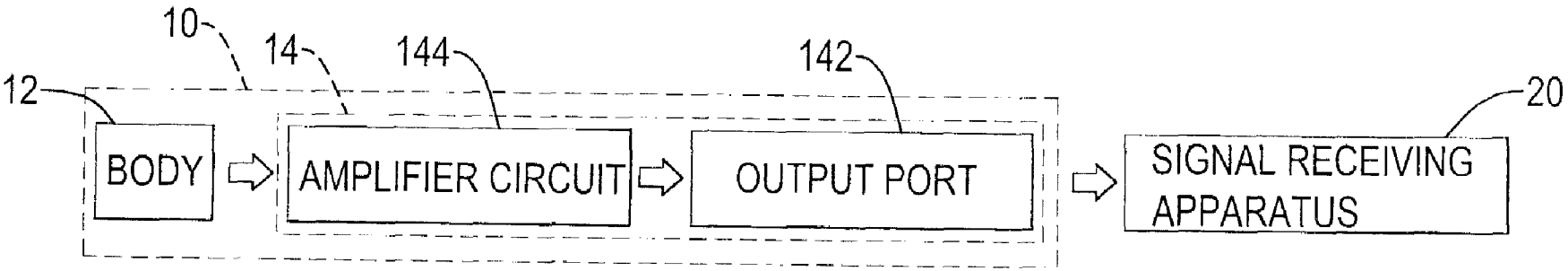
FIG. 4 is a block diagram of a second embodiment of the planer antenna for receiving digital television programs in accordance of the present invention.
Figure 5:
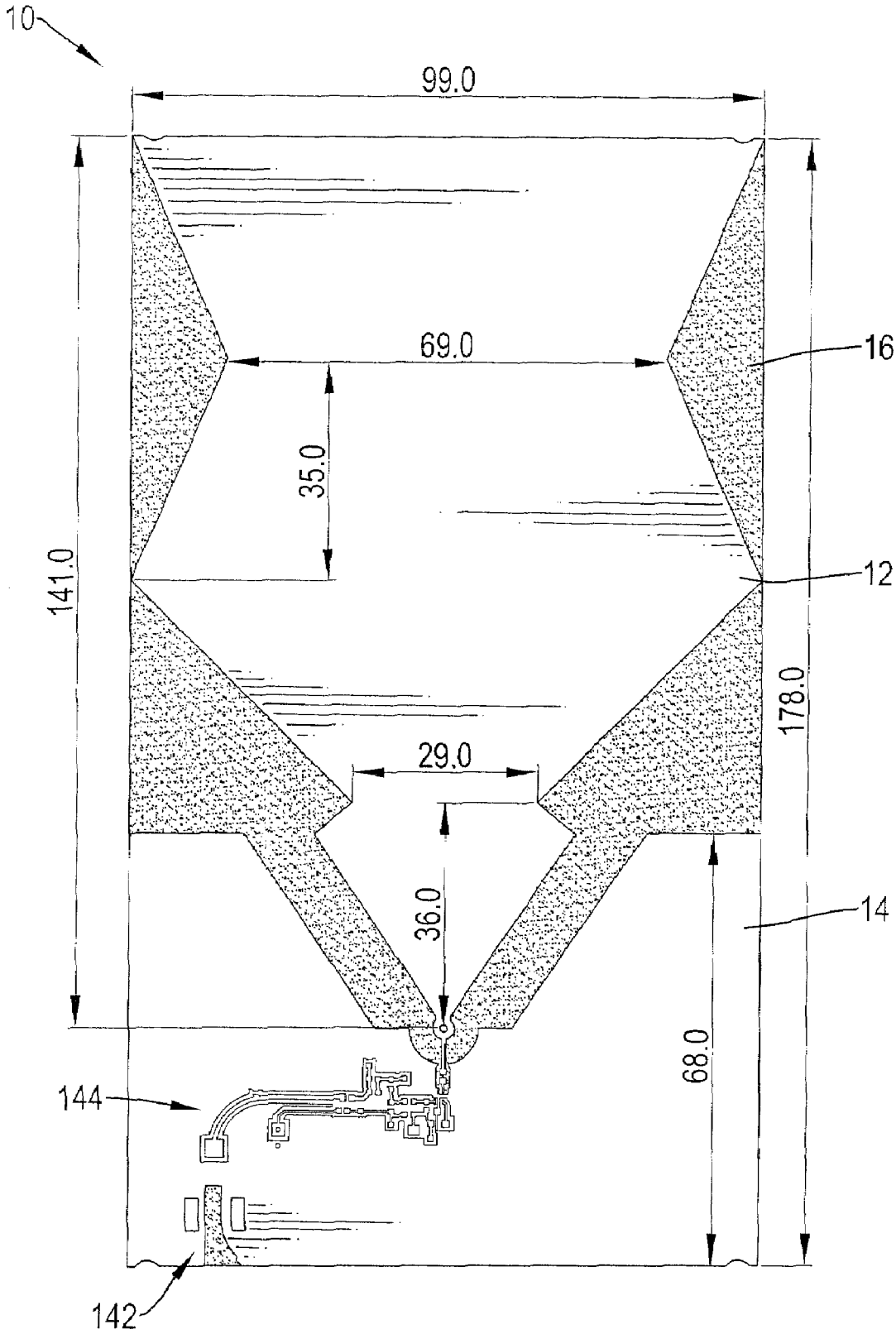
FIG. 5 is a top view of the planer antenna for receiving television programs in FIG. 4.
Figure 6:
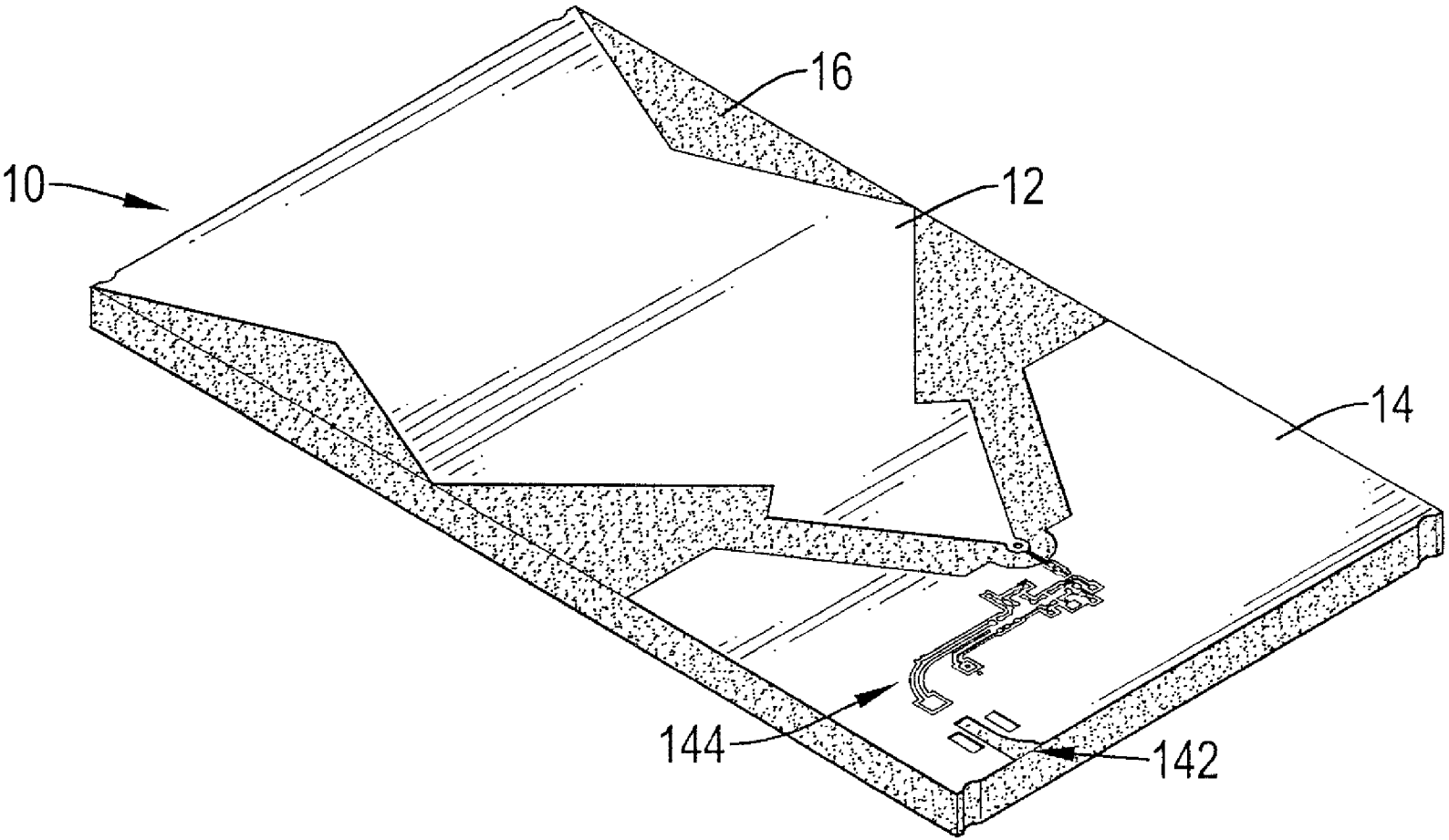
FIG. 6 is a perspective view of the planer antenna for receiving digital television programs in FIG. 5.

With further reference to FIG. 3, a plot of results of return loss (S22) of the first embodiment of the present invention, wherein the return losses at 470 MHz, 606.707 MHz, 737.403 MHz and 1 GHz are −5.932 dB, −17.161 dB, −20.582 dB, −13.403 dB, therefore, the first embodiment of the present invention can be applied for receiving signals from around 470 MHz to around 1 GHz. With further reference to FIGS. 4, 5 and 6, in a second embodiment of the present invention, the interface (14) may have an amplifier circuit (144). The amplifier circuit (144) is a micro-strip circuit and is formed on the interface (14) between the feeding port (122) and the output port (142), and amplifies signals received from the feeding port (122) before relaying amplified signals to the output port (142).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A planer antenna for receiving digital television signals comprising a printed circuit board;

a body being a conductive pattern formed on the printed circuit board, receiving an electromagnetic wave signal of television programs, and having a tip;

a feeding port being a signal output of the body and being formed at the tip; and a line of longitudinal symmetry emanating from the tip, along which a sequence of shapes being formed toward the tip and comprising a trapezoid segment having a base edge being furthest from the tip;

two side edges; and a parallel edge;

a hexagon having a long transverse edge corresponding to and being formed adjacent to the parallel edge of the trapezoid and having two ends a short transverse edge being shorter than the long transverse edge, being parallel to the long transverse edge and having two ends;

two short side edges being formed respectively adjacent to and corresponding to the ends of the long transverse edge of the hexagon; and two long side edges being longer than the short side edges, being formed respectively between the short side edges of the hexagon and the short transverse edge of the hexagon; and a diamond segment having a connecting edge corresponding to and being adjacent to the short transverse edge of the hexagon segment;

two short edges being formed respectively adjacent to the connecting edge of the diamond-like segment; and two long edges being formed respectively between the short edges of the diamond segment and the tip of the body; and two apexes being defined respectively between the corresponding long and short edges of the diamond segment;

an interface being rectangular, conductive pattern, coupling with the body at the feeding port, receiving signals form feeding port, being formed on the circuit board near the feeding port and having two longitudinal edges;

a broken transverse edge being formed aligned with the apexes of the diamond segment of the body;

a breach being a non-conductive and being formed on the broken transverse edge of the interface separating to the body and the feeding port from the interface;

a second transverse edge being parallel to the base edge of the trapezoid; and an output port being formed on the interface.

2. The planer antenna for receiving digital television signals as claimed in claim 1, wherein the base edge, each side edge and the parallel edge of the trapezoid are 99.0 mm, 38.5 mm and 69.0 mm respectively;

the long transverse edge, short transverse edge, short side edge and long side edge of the hexagon segment are 69.0 mm, 29.0 mm, 38.0 mm, and 49.5 mm respectively; and the dimension of the connecting edge, each short edge and each long edge of the diamond segment are 29.0 mm, 7.8 mm, and 36.7 mm respectively.

3. The planer antenna for receiving digital television signals as claimed in claim 2, wherein the interface further has an amplifier circuit amplifying signals from the feeding port before relaying amplified signals to the output port and being a micro-strip circuit formed on the interface between the feeding port and the output port.

4. The planer antenna for receiving digital television signals as claimed in claim 1, wherein the dimension of each longitudinal edge and the second transverse edge of the interface are 68.0 mm and 99.0 mm respectively.

5. The planer antenna for receiving digital television programs as claimed in claim 4, wherein the printed circuit board has one side being covered by a conductive film and the body is formed on the circuit board using co-planar techniques.

6. The planer antenna for receiving digital television programs as claimed in claim 4, wherein the printed circuit board has two sides being covered by conductive films and the body is formed on both sides of the circuit board using micro-strip designing techniques.

7. The planer antenna for receiving digital television programs as claimed in claim 4, wherein a frequency range of the electromagnetic wave signal for television programs is 470 MHz to 860 MHz.

8. The planer antenna for receiving digital television programs as claimed in claim 4, wherein the output port is formed on the second transverse edge of the interface.

* * * * *